US005690074A

United States Patent [19]

Ogawa

[11] Patent Number: 5,690,074

[45] Date of Patent: Nov. 25, 1997

[54] FUEL INJECTION CONTROL SYSTEM FOR INTERNAL COMBUSTION ENGINES

[75] Inventor: Ken Ogawa, Wako, Japan

[73] Assignee: Honda Giken Kogyo Kabushiki Kaisha

[21] Appl. No.: 692,713

[22] Filed: Aug. 6, 1996

[30] Foreign Application Priority Data

Aug. 10, 1995 [JP] Japan ..... 7-224498

[51] Int. Cl.[6] ..... F02M 51/00

[52] U.S. Cl. ..... 123/491

[58] Field of Search ..... 123/491, 436, 123/493, 492, 575, 684; 364/431.1, 431.05, 431.04, 431.07, 431.08

[56] References Cited

U.S. PATENT DOCUMENTS

| | | | |
|---|---|---|---|
| 5,586,544 | 12/1996 | Kitamura et al. | 123/684 |
| 5,595,162 | 1/1997 | Iwai | 123/491 |
| 5,598,826 | 2/1997 | Hunt et al. | 123/491 |
| 5,601,064 | 2/1997 | Fujimoto et al. | 123/491 |

FOREIGN PATENT DOCUMENTS

| | | |
|---|---|---|
| 3-111639 | 3/1991 | Japan . |
| 8-93529 | 8/1996 | Japan . |

*Primary Examiner*—Raymond A. Nelli

*Attorney, Agent, or Firm*—Frishauf, Holtz, Goodman, Langer & Chick

[57] ABSTRACT

A fuel injection control system for an internal combustion engine calculates an amount of fuel to be supplied to the engine, based on operating conditions of the engine including at least load on the engine. The system also calculates an amount of fuel adhering to the inner wall surface of the intake passage of the engine, and an amount of fuel to be carried-off from fuel adhering to the inner wall surface, by the use of adhering fuel parameters representative of transfer characteristics of fuel injected into the intake passage. The amount of fuel to be supplied to the engine is corrected according to the amount of fuel adhering to the inner wall surface of the intake passage and the amount of fuel to be carried-off from fuel adhering to the inner wall surface, to thereby calculate a corrected fuel injection amount. A time period elapsed after the engine is started is measured, and an after-start correction amount of the corrected fuel injection amount is calculated according to the time period elapsed after the engine is started. The corrected fuel injection amount is calculated based on the after-start correction amount of the corrected fuel injection amount until the time period elapsed after the engine is started reaches a predetermined time period.

16 Claims, 13 Drawing Sheets

INTERNAL COMBUSTION ENGINE
INPUT CIRCUIT
C P U
MEMORY MEANS
OUTPUT CIRCUIT
ECU
FUEL INJECTION VALVE
ELECTROMAGNETIC VALVE
IG
CYL
CRK
TW
TA
PBA
θ TH
TC
LAF
POIL
PA

KTWAF MAP

| HIGH ↑ TW | | | | | |
|---|---|---|---|---|---|
| | KTWAF (i, 1) | ..... | ..... | ..... | KTWAF (i, j) |
| | ⋮ | | | ⋰ | ⋮ |
| | KTWAF (3, 1) | | ⋰ | | ⋮ |
| | KTWAF (2, 1) | ⋰ | | | ⋮ |
| | KTWAF (1, 1) | KTWAF (1, 2) | KTWAF (1, 3) | ..... | KTWAF (1, j) |

ME→HIGH NE

FUEL INJECTION CONTROL SYSTEM FOR INTERNAL COMBUSTION ENGINES

BACKGROUND OF THE INVENTION

1. Field of the Invention

This invention relates to a fuel injection control system for internal combustion engines, and more particularly to a fuel injection control system of this kind which controls the amount of fuel injection in dependence on the amount of fuel adhering to the wall surface of the intake pipe of the engine.

2. Prior Art

To enhance the convergence of the air-fuel ratio of a mixture supplied to the engine to a desired air-fuel ratio, reduce noxious components of exhaust gases emitted from the engine, etc., the amount of fuel injected into the engine (hereinafter referred to as "the fuel injection amount") is corrected in dependence on the amount of fuel adhering to the wall surface of the intake pipe of the engine (so-called adhering fuel-dependent correction).

As one of fuel injection control systems which carry out the adhering fuel-dependent correction of the fuel injection amount, there has already been proposed, e.g. by Japanese Laid-Open Patent Publication (Kokai) No. 3-111639, an air-fuel ratio control system for internal combustion engines, in which first a basic fuel injection amount is calculated according to the rotational speed of the engine and load on the engine, engine coolant temperature is detected, the temperature of intake valves to which fuel adheres (intake valve temperature) is estimated based on a value of the intake valve temperature in the equilibrium state and a rate of change in the intake valve temperature, weights to be applied to the two kinds of temperatures, i.e. the engine coolant temperature detected and the intake valve temperature estimated, are determined, an acceleration/deceleration-dependent correction amount is determined according to the engine coolant temperature detected and the intake valve temperature estimated while applying the weights thereto, and the basic fuel injection amount is corrected based on the acceleration/deceleration-dependent correction amount.

Further, another fuel injection control system which carries out adhering fuel-dependent correction has been proposed by the present assignee in Japanese Laid-Open Patent Publication (Kokai) No. 8-93529 (corresponding to U.S. Ser. No. 08/530,406), which controls the fuel injection amount in such a manner that when the fuel injection amount corrected by the adhering fuel-dependent correction is equal to or smaller than a predetermined value, fuel is injected in an amount at least larger than the predetermined value, during or after the start of the engine.

However, the air-fuel ratio control system disclosed in Japanese Laid-Open Patent Publication (Kokai) No. 3-111639 has the following inconvenience: Immediately after the start of the engine, the intake valve temperature, which is one of the principal factors determining the parameters for use in the adhering fuel-dependent correction of the fuel injection amount, drastically changes, causing a change in the degree of evaporation of the fuel adhering to the intake valves, so that the values of parameters become unsuitable for the adhering fuel-dependent correction of the fuel injection amount. This makes it impossible to satisfactorily achieve enhancement of the convergence of the air-fuel ratio of the mixture supplied to the engine to a desired air-fuel ratio, reduction of noxious components of exhaust gases, etc., immediately after the start of the engine.

Similarly, the fuel injection control system according to Japanese Laid-Open Patent Publication (Kokai) No. 8-93529 proposed by the present assignee does not take into account a change in the degree of evaporation of the fuel adhering to the intake valves, which is caused by such a drastic change in the intake valve temperature immediately after the start of the engine, so that it is impossible to carry out appropriate adhering fuel-dependent correction of the fuel injection amount depending on the temperature of the intake valves. Therefore, the system can suffer from a similar unfavorable result to that described as to Japanese Laid-Open Patent Publication (Kokai) No. 3-111639.

SUMMARY OF THE INVENTION

It is an object of the invention to provide a fuel injection control system for an internal combustion engine, which is capable of properly controlling the amount of fuel supplied to the combustion chamber of the engine immediately after the start (cranking) thereof, to thereby satisfactorily achieve enhancement of the convergence of the air-fuel ratio of a mixture supplied to the engine to a desired air-fuel ratio, reduction noxious components of exhaust gases emitted from the engine, etc.

To attain the above object, according to a first aspect of the invention, there is provided in a fuel injection control system for an internal combustion engine having an intake passage having an inner wall surface, and at least one combustion chamber, the fuel injection control system including fuel supply amount-calculating means for calculating an amount of fuel to be supplied to the engine, based on operating conditions of the engine including at least load on the engine, adhering fuel amount-calculating means for calculating an amount of fuel adhering to the inner wall surface of the intake passage of the engine, by the use of adhering fuel parameters representative of transfer characteristics of fuel injected into the intake passage, carried-off fuel amount-calculating means for calculating an amount of fuel to be carried off from the fuel adhering to the inner wall surface of the intake passage into the at least one combustion chamber, by the use of the adhering fuel parameters, corrected fuel injection amount-calculating means for calculating a corrected fuel injection amount by correcting of the amount of fuel calculated by the fuel supply amount-calculating means according to the amount of fuel adhering to the inner wall surface of the intake passage and the amount of fuel to be carried-off from the fuel adhering to the inner wall surface, and fuel injection control means for injecting fuel in the corrected fuel injection amount into the intake passage.

The fuel injection control system according to the first aspect of the invention is characterized by comprising:

after-start time period-measuring means for measuring a time period elapsed after the engine is started; and after-start correction amount-calculating means for calculating an after-start correction amount of the corrected fuel injection amount according to the time period elapsed after the engine is started;

and the corrected fuel injection amount-calculating means calculates the corrected fuel injection amount based on the after-start correction amount of the corrected fuel injection amount until the time period elapsed after the engine is started reaches a predetermined time period.

Preferably, the after-start time period-measuring means measures the time period elapsed after the engine is started by counting a number of cycles of fuel injection of the engine occurring after the engine is started.

More preferably, the engine includes a plurality of cylinders, the after-start time period-measuring means calculating a cumulative number of pulses generated at a predetermined crank angle position of a particular cylinder of the plurality of cylinders and measuring the time period elapsed after the engine is started based on the cumulative number of the pulses.

Preferably, the after-start correction amount-calculating means calculates the after-start correction amount in a manner such that the after-start correction amount becomes smaller as the time period elapsed after the engine is started becomes closer to the predetermined time period.

Preferably, the adhering fuel parameters comprise a direct supply ratio representative of a ratio of an amount of fuel directly drawn into the at least one combustion chamber during one cycle of fuel injection to an amount of fuel injected during the one cycle, and a carried-off ratio representative of a ratio of an amount of fuel to be carried off from the fuel adhering to the inner wall surface of the intake passage to an amount of fuel adhering to the inner wall surface of the intake passage during the one cycle of fuel injection, the after-start correction amount-calculating means calculating the after-start correction amount of the corrected fuel injection amount by the use of a correction coefficient for correcting the direct supply ratio and a correction coefficient for correcting the carried-off ratio each set according to the time period elapsed after the engine is started.

Further preferably, the correction coefficient for the direct supply ratio and the correction coefficient for correcting the carried-off ratio are each set according to the time period elapsed after the engine is started in a manner such that the corrected fuel injection amount becomes smaller as the time period elapsed after the engine is started becomes closer to the predetermined time period.

Preferably, the fuel injection control system includes starting condition-detecting means for detecting a starting condition of the engine, and the corrected fuel injection amount-calculating means calculates the corrected fuel injection amount based on a during-start correction amount calculated in a manner suitable for the starting condition of the engine instead of the after-start correction amount of the corrected fuel injection amount, the fuel injection control means injecting fuel into the intake passage in an amount at least larger than a predetermined value if the corrected fuel injection amount calculated based on the during-start correction amount is below the predetermined value.

According to a second aspect of the invention, there is provided a fuel injection control system which is characterized by comprising:

count means for counting a number of times of explosion of the engine; and after-start correction amount-calculating means for calculating an after-start correction amount of the corrected fuel injection amount according to the number of times of explosion of the engine, and the corrected fuel injection amount-calculating means calculates the corrected fuel injection amount based on the after-start correction amount of the corrected fuel injection amount until the number of times of explosion of the engine reaches a predetermined number.

Preferably, the engine includes a plurality of cylinders, the count means calculating a cumulative number of pulses generated at a predetermined crank angle position of each of the plurality of cylinders and measuring the number of times of explosion based on the cumulative number of the pulses.

Preferably, the after-start correction amount-calculating means calculates the after-start correction amount in a manner such that the after-start correction amount becomes smaller as the number of times of explosion of the engine becomes closer to the predetermined number.

Preferably, the adhering fuel parameters comprise a direct supply ratio representative of a ratio of an amount of fuel directly drawn into the at least one combustion chamber during one cycle of fuel injection to an amount of fuel injected during the one cycle, and a carried-off ratio representative of a ratio of an amount of fuel to be carried off from the fuel adhering to the wall surface of the intake passage to an amount of fuel adhering to the inner wall surface of the intake passage during the one cycle of fuel injection, the after-start correction amount-calculating means calculating the after-start correction amount of the corrected fuel injection amount by the use of a correction coefficient for correcting the direct supply ratio and a correction coefficient for correcting the carried-off ratio each set according to the number of times of explosion.

More preferably, the correction coefficient for the direct supply ratio and the correction coefficient for correcting the carried-off ratio are each set according to the number of times of explosion in a manner such that the corrected fuel injection amount becomes smaller as the number of times of explosion of the engine becomes closer to the predetermined number.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof.

Figure 1:
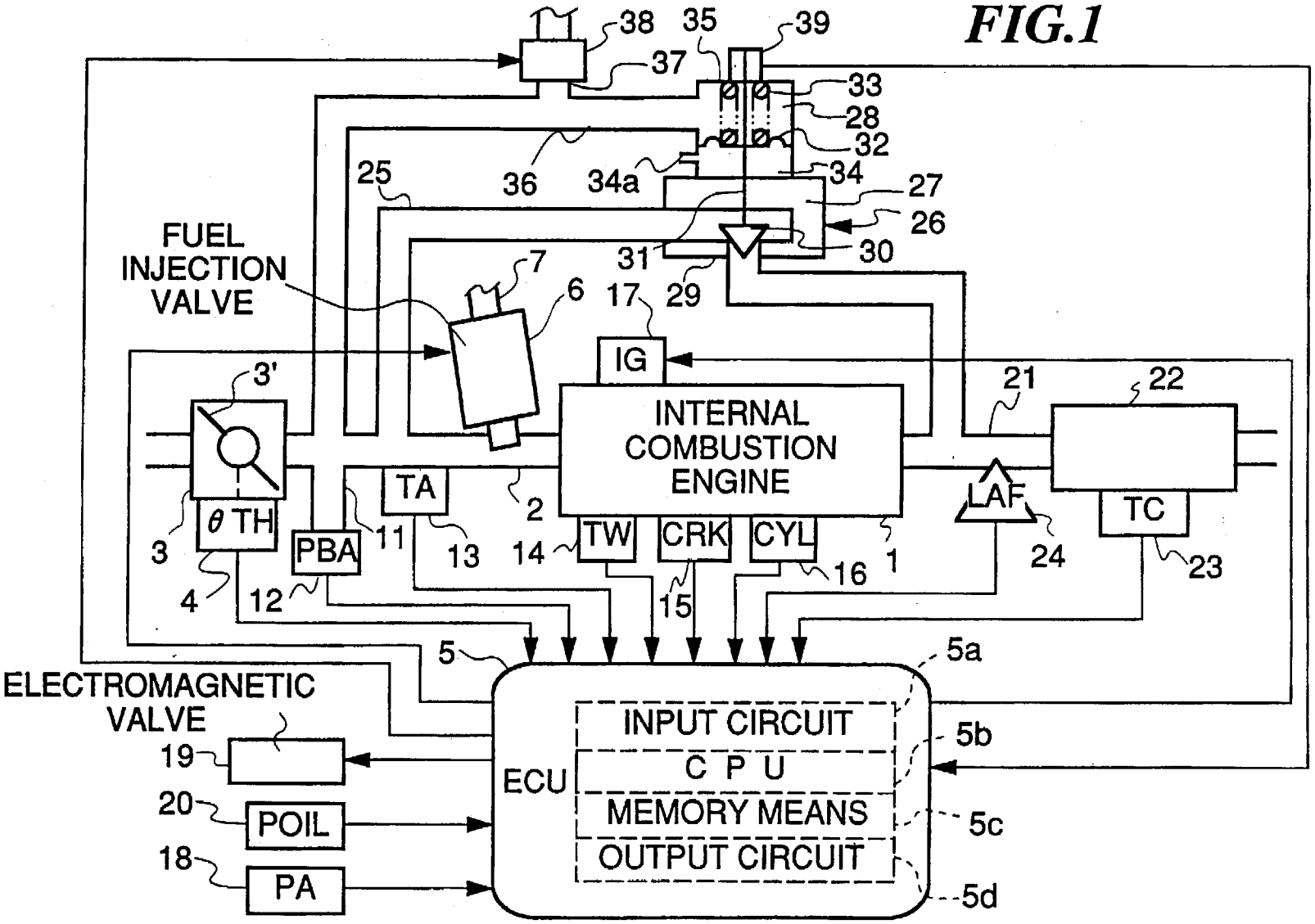
FIG. 1 is a diagram showing the arrangement of an internal combustion engine incorporating a fuel injection control system therefor, according to an embodiment of the invention.

Referring first to FIG. 1, there is illustrated the whole arrangement of an internal combustion engine incorporating a fuel injection control system according to an embodiment of the invention.

In the figure, reference numeral 1 designates a DOHC straight type four-cylinder engine (hereinafter simply referred to as "the engine"), each cylinder being provided with a pair of intake valves, not shown, and a pair of exhaust valves, not shown. This engine 1 is constructed such that it is capable of changing operating characteristics of the intake valves and exhaust valves, i.e. the valve opening period and the valve lift (generically referred to hereinafter as "the valve timing"), between a high speed valve timing (hereinafter referred to as "the high speed V/T") suitable for operation of the engine in a high engine speed region and a low speed valve timing (hereinafter referred to as "the low speed V/T") suitable for operation of the engine in a low engine speed region.

Connected to intake ports, not shown, of the cylinder block of the engine 1 is an intake pipe 2 across which is arranged a throttle body 3 accommodating a throttle valve 3' therein. A throttle valve opening (θTH) sensor 4 is connected to the throttle valve 3' for generating an electric signal indicative of the sensed throttle valve opening (θTH) and supplying the same to an electronic control unit (hereinafter referred to as "the ECU 5").

Fuel injection valves 6, only one of which is shown, are inserted into the intake pipe 2 at locations intermediate between the throttle valve 3' and the cylinder block of the engine 1 and slightly upstream of respective intake valves. The fuel injection valves 6 are connected to a fuel pump, not shown, via a fuel supply pipe 7 and electrically connected to the ECU 5 to have their valve opening periods controlled by signals therefrom.

Further, an intake pipe absolute pressure (PBA) sensor 12 is provided in communication with the interior of the intake pipe 2 via a conduit 11 opening into the intake pipe 2 at a location downstream of the throttle valve 3' for supplying an electric signal indicative of the sensed absolute pressure PBA within the intake pipe 2 to the ECU 5.

An intake air temperature (TA) sensor 13 is inserted into the intake pipe 2 at a location downstream of the PBA sensor 12 and close to the intake valves for supplying an electric signal indicative of the sensed intake air temperature TA to the ECU 5.

An engine coolant temperature (TW) sensor 14 formed of a thermistor or the like is inserted into a coolant passage formed in the cylinder block and filled with a coolant, for supplying an electric signal indicative of the sensed engine coolant temperature TW to the ECU 5.

A crank angle (CRK) sensor 15 and a cylinder-discriminating (CYL) sensor 16 are arranged in facing relation to a camshaft or a crankshaft of the engine 1, neither of which is shown.

The CRK sensor 15 generates a pulse (hereinafter referred to as "CRK signal pulse") at each of predetermined crank angle positions whenever the crankshaft rotates through a predetermined angle (e.g. 30 degrees) smaller than half a rotation (180 degrees) of the crankshaft of the engine 1, while the CYL sensor 16 generates a pulse (hereinafter referred to as "CYL signal pulse") at a predetermined crank angle position of a particular cylinder of the engine, both of the CRK signal pulse and the CYL signal pulse being supplied to the ECU 5.

Each cylinder of the engine has a spark plug 17 electrically connected to the ECU 5 to have its ignition timing controlled by a signal therefrom. Further, an atmospheric pressure (PA) sensor 18 is arranged at a suitable location of the engine 1 for supplying an electric signal indicative of the sensed atmospheric pressure (PA) to the ECU 5.

Further, an electromagnetic valve 19 is connected to an output side of the ECU 5, for making changeover of the valve timing. The electromagnetic valve 19 has opening and closing operations thereof controlled by the ECU 5, to select either high or low hydraulic pressure applied to a valve timing changeover device, not shown. Responsive to this high or low hydraulic pressure selected, the valve timing changeover device operates to change the valve timing to either the high speed V/T or the low speed V/T. The hydraulic pressure applied to the valve timing changeover device is detected by a hydraulic pressure (oil pressure) (Poil) sensor 20 which supplies a signal indicative of the sensed hydraulic pressure to the ECU 5.

A catalytic converter (three-way catalyst) 22 is arranged in an exhaust pipe 21 connected to exhaust ports, not shown, of the engine 1 for purifying noxious components, such as HC, CO, NOx, which are present in exhaust gases from the engine.

A catalyst temperature (TC) sensor, which is formed of a thermistor or the like, is inserted into a wall of the catalytic converter 22 for supplying a signal indicative of the sensed temperature of a catalyst bed of the catalytic converter 22 to the ECU 5.

A linear output air-fuel ratio sensor (hereinafter referred to as "the LAF sensor") 24 is arranged in the exhaust pipe 21 at a location upstream of the catalytic converter 22. The LAF sensor 24 supplies an electric signal which is substantially proportional to the concentration of oxygen present in the exhaust gases to the ECU 5.

An exhaust gas recirculation passage 25 is arranged between the intake pipe 2 and the exhaust pipe 21 in a fashion bypassing the engine 1. The exhaust gas recirculation passage 25 has one end thereof connected to the exhaust pipe 21 at a location upstream of the LAF sensor 24 (i.e. on the engine side of the LAF sensor), and the other end thereof connected to the intake pipe 2 at a location downstream of the PBA sensor 12.

An exhaust gas recirculation control valve (hereinafter referred to as "the EGR valve") 26 is arranged in the exhaust gas recirculation passage 25 for carrying out exhaust gas recirculation control (hereinafter referred to as "the EGR control"). The EGR valve 26 is comprised of a casing 29 defining a valve chamber 27 and a diaphragm chamber 28 therein, a valving element 30 in the form of a wedge arranged in the valve chamber 27, which is vertically movable so as to open and close the exhaust gas recirculation passage 25, a diaphragm 32 connected to the valving element 30 via a valve stem 31, and a spring 33 urging the diaphragm 32 in a valve-closing direction. The diaphragm chamber 28 is divided by the diaphragm 32 into an atmospheric pressure chamber 34 on the valve stem side and a negative pressure chamber 35 on the spring side.

The atmospheric pressure chamber 34 is communicated with the atmosphere via an air inlet port 34*a*, while the negative pressure chamber 35 is connected to one end of a negative pressure-introducing passage 36. The negative pressure-introducing passage 36 has the other end thereof connected to the intake pipe 2 at a location between the throttle valve 3' and the other end of the exhaust gas recirculation passage 25, for introducing the absolute pressure PBA (negative pressure) into the negative pressure chamber 35. The negative pressure-introducing passage 36 has an air-introducing passage 37 connected to an intermediate portion thereof, and the air-introducing passage 37 has a pressure control valve 38 arranged therein for carrying out the EGR control. The pressure control valve 38 is an electromagnetic valve of a normally-closed type, and controls introduction of the atmospheric pressure into the air-introducing passage 37 to adjust control pressure created within the negative pressure chamber 35 of the diaphragm chamber 28 to a predetermined level.

A valve opening (lift) sensor (hereinafter referred to as "the L sensor for EGR") 39 is provided for the EGR valve 26, which detects an operating position (lift amount) of the valving element 30 thereof, and supplies a signal indicative of the sensed lift amount to the ECU 5. In addition, the EGR control is performed after the engine has been warmed up (e.g. when the engine coolant temperature TW is equal to or higher than a predetermined value).

The ECU 5 is comprised of an input circuit 5*a* having the functions of shaping the waveforms of input signals from various sensors including those mentioned above, shifting the voltage levels of sensor output signals to a predetermined level, converting analog signals from analog-output sensors to digital signals, and so forth, a central processing unit (hereinafter referred to as the "the CPU") 5*b*, a memory device 5*c* formed of a ROM storing various operational programs which are executed by the CPU 5*b*, and various maps and tables, referred to hereinafter, and a RAM for storing results of calculations therefrom, etc., and an output circuit 5*d* which outputs respective driving signals to the fuel injection valves 6, the spark plugs 17, the electromagnetic valve 19, etc.

Figure 2:
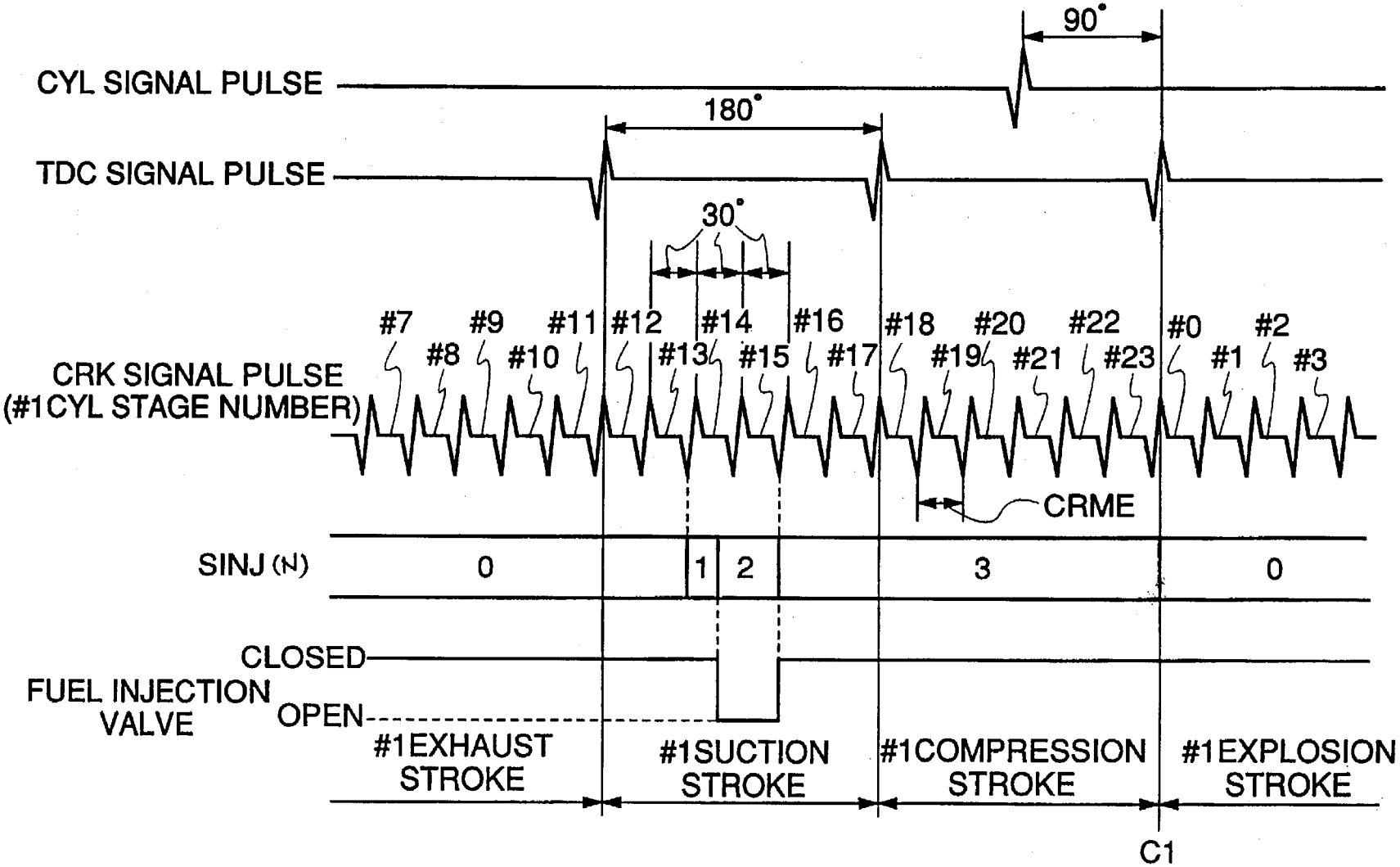
FIG. 2 is a timing chart showing signal pulses generated in synchronism with rotation of the engine, and fuel injection timing.

FIG. 2 shows the relationship in timing between CRK signal pulses from the CRK sensor 15, a CYL signal pulse from the CYL sensor 16, TDC signal pulses, and fuel injection timing by the fuel injection valves 6. 24 CRK signal pulses, for example, are generated per two rotations of the crankshaft at regular intervals, i.e. whenever the crankshaft rotates through 30 degrees starting from the top dead center position of any of the four cylinders (#1 to #4 CYL). The ECU 5 generates a TDC signal pulse in synchronism with a CRK signal pulse generated at the top dead center position of each cylinder. TDC signal pulses generated sequentially indicate reference crank angle positions of the respective cylinders and are each generated whenever the crankshaft rotates through 180 degrees. The ECU 5 measures time intervals of generation of CRK signal pulses to calculate CRME values, which are added together over a time period of generation of two TDC signal pulses i.e. over a time period of one rotation of the crankshaft to calculate an ME value, and then calculates the engine rotational speed NE therefrom, which is the reciprocal of the ME value.

CYL signal pulses are each generated, as briefly described above, at a predetermined crank angle position of a particular cylinder (cylinder #1 in the illustrated example), e.g. when the #1 cylinder is in a position 90 degrees before a TDC position thereof corresponding to the end of the compression stroke of the cylinder, to thereby allot a particular cylinder number (e.g. #1 CYL) to a TDC signal pulse generated immediately after the CYL signal pulse is generated.

The ECU 5 detects crank angle stages (hereinafter merely referred to as "stages") in relation to the reference crank angle position of each cylinder, based on TDC signal pulses and CRK signal pulses. More specifically, the ECU 5 determines, for instance, that the #1 cylinder is in a #0 stage when a CRK signal pulse is generated, which corresponds to a TDC signal pulse generated at the end of compression stroke of the #1 cylinder and immediately following a CYL signal pulse. The ECU sequentially determines thereafter that the #1 cylinder is in a #1 stage, a #2 stage, . . . and a #23 stage, based on CRK signal pulses generated thereafter.

Further, an injection stage of a cylinder at which injection should be started is determined depending on operating conditions of the engine, more particularly by executing an injection stage-determining routine, not shown. Further, a valve opening period (fuel injection period TOUT) is controlled by the use of a status number (SINJ(N)) set in relation to the injection stage.

More specifically, the status number SINJ(N) is set to "2" during the valve opening period of the fuel injection valve 6, and changed to "3" immediately after termination of the fuel injection. The status number SINJ(N) is reset to "0" simultaneously when the explosion stroke starts, to set the fuel injection valve 6 into a standby state for injection. When the cylinder subsequently reaches the next injection stage (e.g. the #13 stage), the status number SINJ(N) is set to "1", and after an injection delay time period dependent on the fuel injection period TOUT elapses, the status number SINJ(N) is again set to "2" to start fuel injection via the fuel injection valve 6. After termination of the fuel injection, the status number SINJ(N) is again set to "3", and upon start of the explosion stroke, it is again reset to "0". In the present embodiment, as will be described hereinafter with reference to FIG. 17, an amount of fuel adhering to the inner wall surface of the intake pipe 2 (hereinafter referred to as "the adhering fuel amount TWP") is calculated when SINJ(N)=3 holds, and then the fuel injection period TOUT is calculated by taking the adhering fuel amount TWP into account. The injection delay time period (corresponding to the time period over which the status number SINJ(N) is equal to "1") is provided for controlling the injection timing such that the termination of fuel injection is synchronous with generation of a CRK signal pulse. By provision of the predetermined injection delay time period, the timing of termination of fuel injection is controlled to a predetermined timing.

Next, an adhering fuel-dependent correction processing of the present embodiment will be described with reference to FIGS. 3 to 17. Flowcharts in these figures are expressed according to a program notation defined by JIS X 0128, i.e. by the use of SPD (Structured Programming Diagrams).

Figure 3:
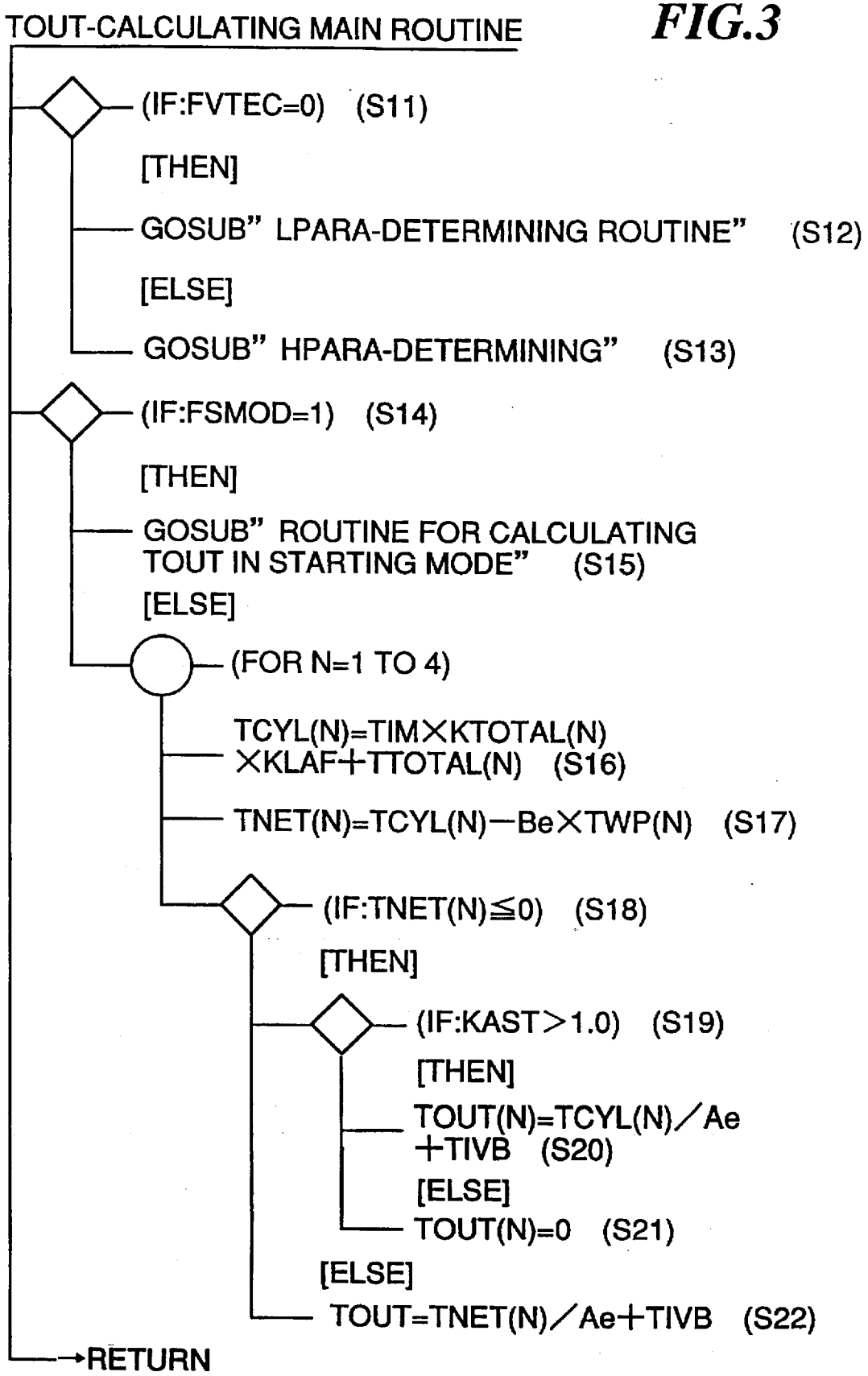
FIG. 3 is a flowchart showing a main routine for calculating a fuel injection period (TOUT)

FIG. 3 shows a main routine for calculating the fuel injection period TOUT by carrying out the adhering fuel-dependent correction of the fuel injection amount, which is executed in synchronism with generation of each TDC signal pulse.

First, at a step S11, it is determined whether or not a flag FVTEC assumes "0", i.e. whether the valve timing is selected to the low speed V/T. If FVTEC=0 holds, i.e. if it is determined that the valve timing is selected to the low speed V/T, an LPARA-determining routine is executed at a step S12 to determine a fuel injection timing θINJ suitable for the low speed V/T as well as adhering fuel-determining parameters suitable for the low speed V/T, i.e. a value of a final direct supply ratio Ae and a value of a final carry-off ratio Be of gasoline (injected fuel) for use in fuel injection control during the low speed V/T.

The final direct supply ratio Ae and the final carry-off ratio Be are obtained by correcting a basic direct supply ratio A and a basic carry-off ratio B, respectively, by the use of engine speed-dependent correction coefficients KA, KB and EGR-dependent correction coefficients KEA, KEB, or by the use of engine speed-dependent correction coefficients KA, KB, EGR-dependent correction coefficients KEA, KEB and after-start adhering fuel-determining parameter correction coefficients KASA, KASB. The basic direct supply ratio A means a basic value of the ratio of an amount of fuel injected by the fuel injection valve 6 and directly drawn into the combustion chamber during the present cycle to the amount of fuel injected by the fuel injection valve 6 during the present cycle, while the basic carry-off ratio is a basic value of the ratio of an amount of fuel vaporized and carried off from fuel adhering to the inner wall surface of the intake pipe 2 to be drawn into the combustion chamber during the present cycle, to the amount of the fuel adhering to the inner wall surface of the intake pipe 2.

Figure 4:
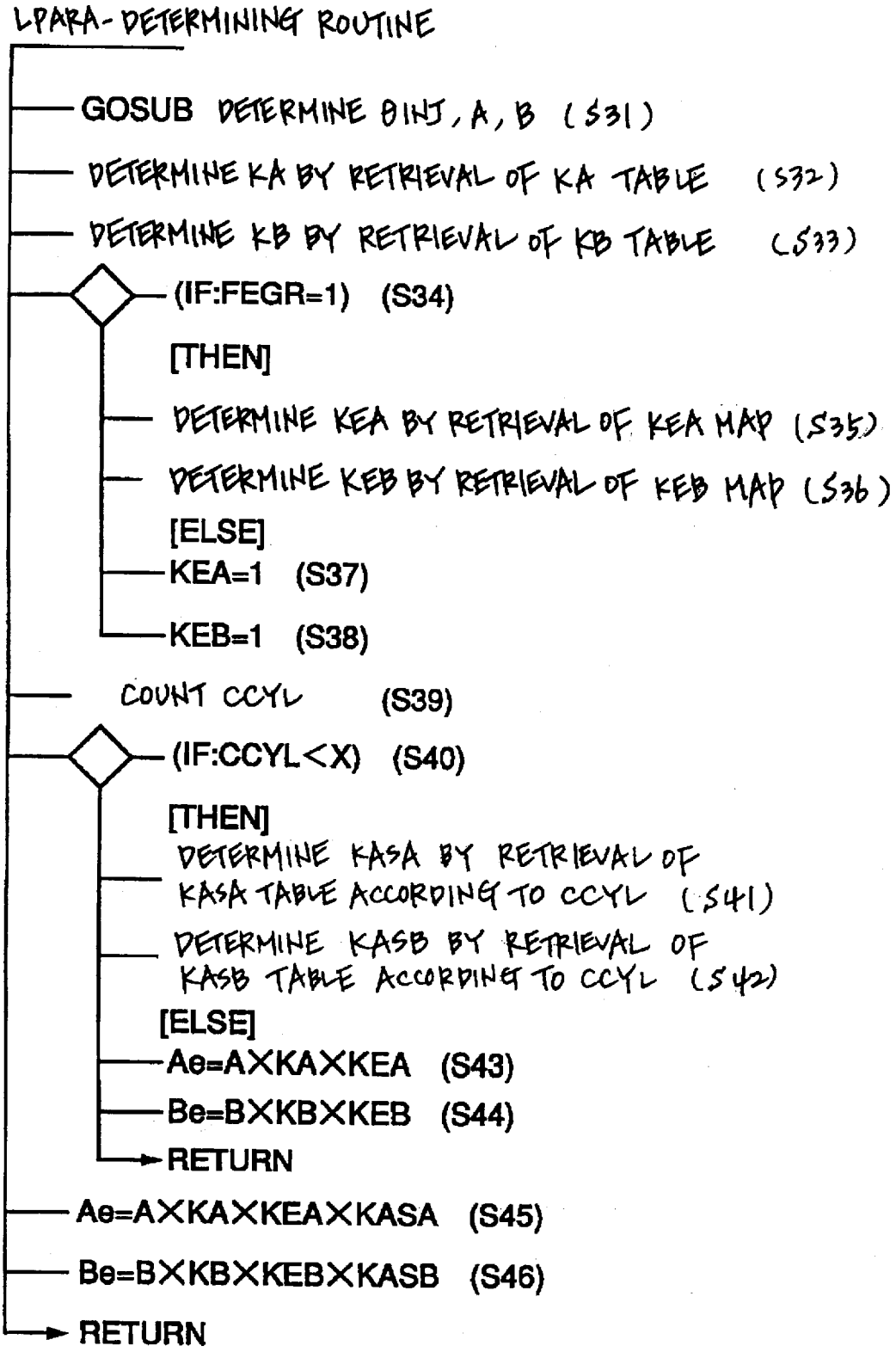
FIG. 4 is a flowchart showing a routine for determining parameters for use in the execution of an adhering fuel-dependent correction of the fuel injection amount.

FIG. 4 shows the LPARA-determining routine for determining the above-mentioned adhering fuel-determining parameters, which is executed in synchronism with generation of each TDC signal pulse. First, at a step S31, a fuel injection timing-determining routine is executed to determine a fuel injection timing (in the present embodiment, the timing of termination of fuel injection) θINJ as well as the basic direct supply ratio A and the basic direct carry-off ratio B.

In the present routine, the fuel injection timing θINJ is determined based on the intake pipe absolute pressure PBA and the engine coolant temperature TW, and the basic direct supply ratio A and the basic carry-off ratio B are calculated based on the determined fuel injection timing θINJ.

Figure 5:
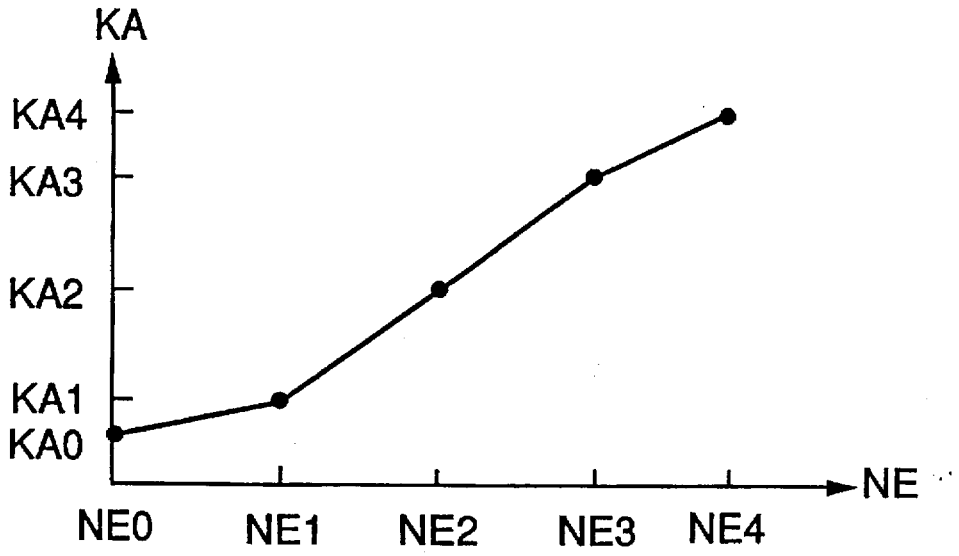
FIG. 5 shows a table for determining a correction coefficient (KA) applied in determining a parameter (Ae) for use in the adhering fuel-dependent correction.

Then, at a step S32, the engine speed-dependent correction coefficient KA for the final direct supply ratio Ae is determined by retrieving a KA table. The KA table is set, e.g. as shown in FIG. 5, such that table values KA0 to KA4 are provided in a manner corresponding to predetermined values NE0 to NE4 of the engine rotational speed NE. The engine speed-dependent correction coefficient KA is determined by retrieving the KA table, and additionally by interpolation, if required.

Figure 6:
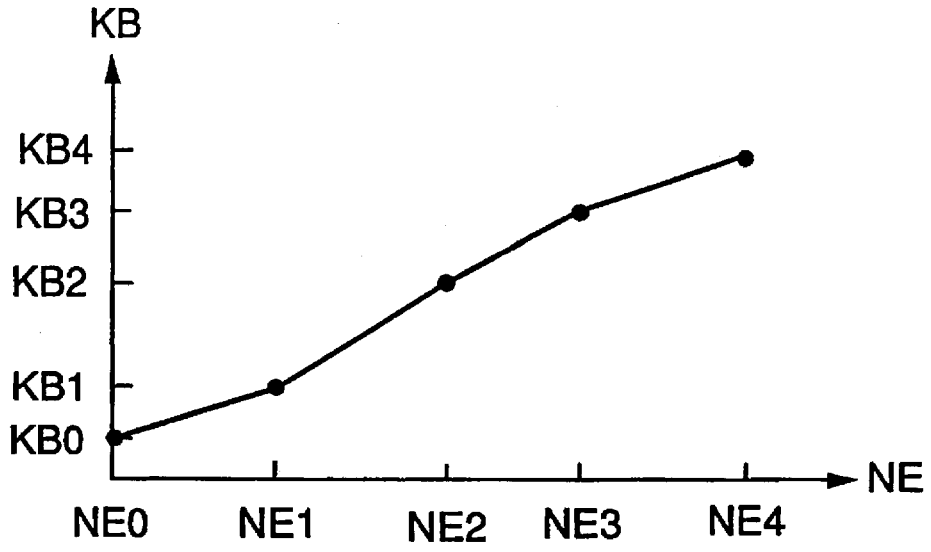
FIG. 6 shows a table for determining a correction coefficient (KB) applied in determining a parameter (Be) for use in the adhering fuel-dependent correction.

Then, at a step S33, the engine speed-dependent correction coefficient KB for the final carry-off ratio Be is determined by retrieving a KB table. The KB table is set similarly to the KA table, e.g. as shown in FIG. 6, such that table values KB0 to KB4 are provided in a manner corresponding to predetermined values NE0 to NE4 of the engine rotational speed NE. The engine speed-dependent correction coefficient KB is determined by retrieving the KB table, and additionally by interpolation, if required.

Then, at a step S34, it is determined whether or not a flag FEGR assumes "1", i.e. whether or not the engine is in an EGR-operating region. Whether the engine is in the EGR-operating region is determined by determining whether the engine coolant temperature TW is above a predetermined value to be assumed when the engine has been warmed up, more specifically, by executing an EGR-operating region-determining routine, not shown. If FEGR=1 holds, i.e. if the engine is determined to be in the EGR-operating region, the program proceeds to a step S35, wherein the EGR-dependent correction coefficient KEA for the final direct supply ratio Ae is determined by retrieving a KEA map in which map values are set according to the intake pipe absolute pressure PBA and the EGR-dependent correction coefficient KEGR to be applied in calculation of the fuel injection amount during the EGR control.

Then, at a step S36, the EGR-dependent correction coefficient KEB for the final carry-off ratio Be is determined by retrieving a KEB map in which map values of the EGR-dependent correction coefficient KEB are set according to the intake pipe absolute pressure PBA and the EGR-dependent correction coefficient KEGR, similarly to the KEA map.

On the other hand, if FEGR=0 holds, i.e. if it is determined that the engine is not in the EGR-operating region, the EGR-dependent correction coefficients KEA, KEB are both set to "1.0" at steps S37 and S38, respectively.

Then, the program proceeds to a step S39, wherein each CYL signal pulse, if generated, is counted to obtain a count or cumulative value CCYL of CYL signal pulses generated after the start of the engine.

At the following step S40, it is determined whether or not the count CCYL is smaller than a predetermined value X, to thereby determine whether or not a time period corresponding to the predetermined count X has elapsed after the start of the engine.

If it is determined at the step S40 that the count CCYL is smaller than the predetermined count X, i.e. if the time period corresponding to the predetermined count X has not elapsed after the start of the engine, the program proceeds to a step S41, wherein the after-start adhering fuel-determining parameter correction coefficient KASA for the final direct supply ratio Ae is calculated by retrieving a KASA table set according to the count CCYL.

Figure 7:
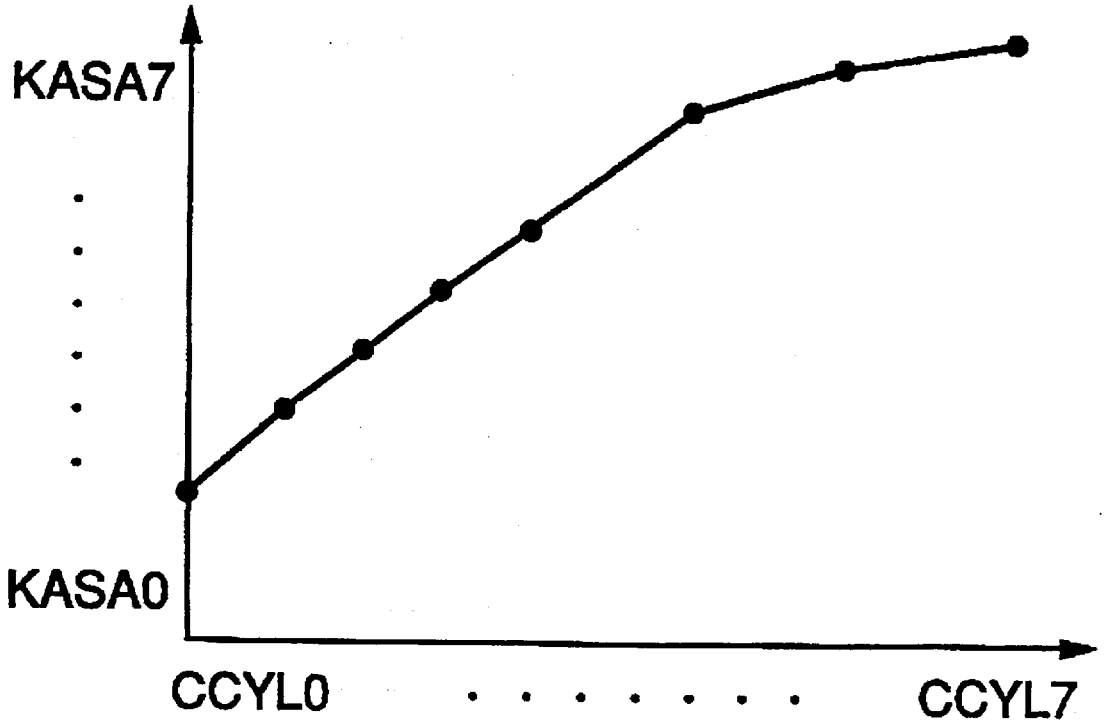
FIG. 7 shows a table for determining a correction coefficient (KASA) applied in determining the parameter (Ae) for use in the execution of an after-start adhering fuel-dependent correction of the fuel injection amount.

The KASA table is set, e.g. as shown in FIG. 7, such that table values KASA0 to KASA7 are provided in a manner corresponding to predetermined count values CCYL0 to CCYL7 of the CYL signal pulses. The after-start adhering fuel-determining parameter correction coefficient KASA is determined by retrieving the KASA table, and additionally by interpolation, if required. As shown in FIG. 7, the after-start adhering fuel-determining parameter correction coefficient KASA is set to a larger value as the count CCYL is larger, i.e. the amount of correction by the correction coefficient KASA becomes smaller as the time period elapsed after the start of the engine is longer.

At a step S42, similarly to the after-start adhering fuel-determining parameter correction coefficient KASA, the after-start adhering fuel-determining parameter correction coefficient KASB for the final carry-off ratio Be is calculated by retrieving a KASB table set according to the count CCYL.

Figure 8:
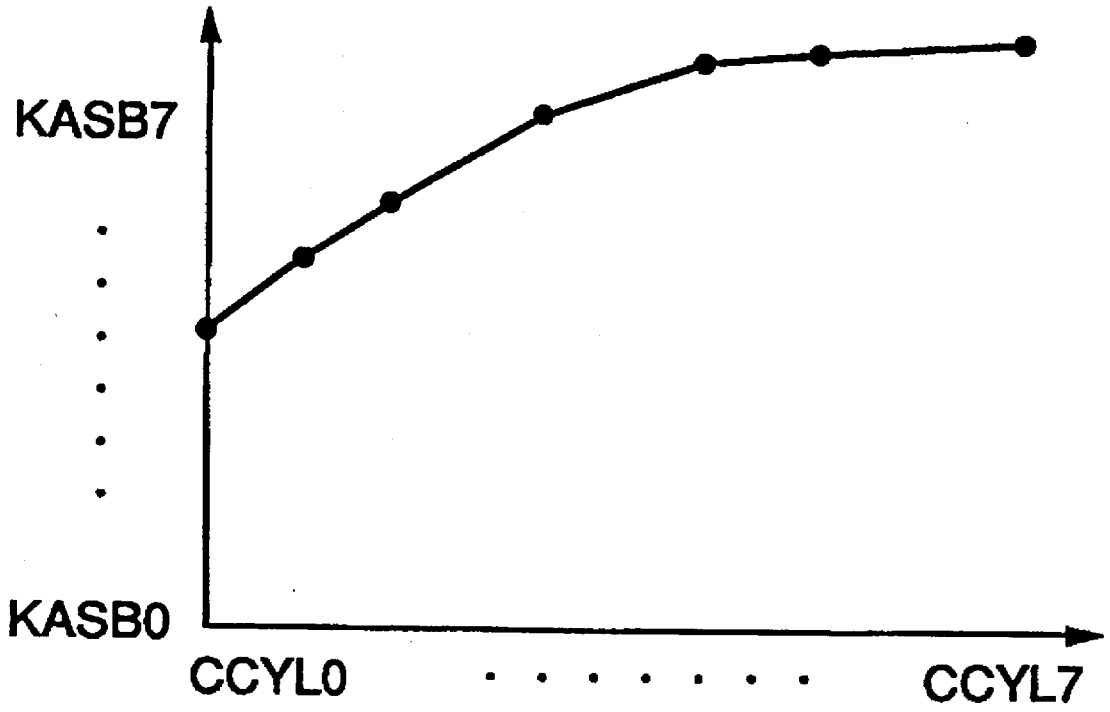
FIG. 8 shows a table for determining a correction coefficient (KASB) applied in determining the parameter (Be) for use in the execution of an after-start adhering fuel-dependent correction of the fuel injection amount.

The KASB table is set, e.g. as shown in FIG. 8, such that table values KASB0 to KASB7 are provided in a manner corresponding to the predetermined count values CCYL0 to CCYL7 of the CYL signal pulses. The after-start adhering fuel-determining parameter correction coefficient KASB is determined by retrieving the KASB table, and additionally by interpolation, if required. As shown in FIG. 8, the after-start adhering fuel-determining parameter correction coefficient KASB is also set to a larger value as the count CCYL is larger, i.e. the amount of correction by the correction coefficient KASB becomes smaller as the time period elapsed after the start of the engine is longer.

Then, at steps S45 and S46, the final direct supply ratio Ae and the final carry-off ratio Be are calculated by the use of the following equations (1) and (2), respectively, followed by terminating the program and returning to the FIG. 3 main routine:

$$Ae=A\times KA\times KEA\times KASA \quad (1)$$

$$Be=B\times KB\times KEB\times KASB \quad (2)$$

On the other hand, if it is determined at the step S40 that the count CCYL is equal to or larger than the predetermined count X, i.e. if the time period corresponding to the predetermined count X has elapsed after the start of the engine, the program proceeds to steps S43 and S44, wherein the final direct supply ratio Ae and the final carry-off ratio Be are calculated by the use of the following equations (3) and (4), respectively, followed by terminating the program and returning to the FIG. 3 main routine:

$$Ae=A\times KA\times KEA \quad (3)$$

$$Be=B\times KB\times KEB \quad (4)$$

If it is determined at the step S11 in FIG. 3 that the flag FVTEC assumes "1", the program proceeds to a step S13, wherein an HPARA-determining routine, not shown, which is similar to the LPARA-determining routine, is executed to determine the fuel injection timing θINJ and the adhering fuel-determining parameters (the final direct supply ratio Ae and the final carry-off ratio Be) suitable for the high speed V/T.

Then, the program proceeds to a step S14, wherein it is determined whether or not a flag FSMOD assumes "1". If FSMOD=1 holds, it is judged that the engine is in the starting mode, and then the program proceeds to a step S15, wherein a final fuel injection period TOUT suitable for the starting mode is calculated by a routine shown in FIG. 9. In the following description, the parameter referred to as "the fuel amount" or "the fuel injection amount" is calculated in terms of a valve opening period during which each of the fuel injection valves 6 is opened for fuel injection, and hence has a dimension of "time".

Figure 9:
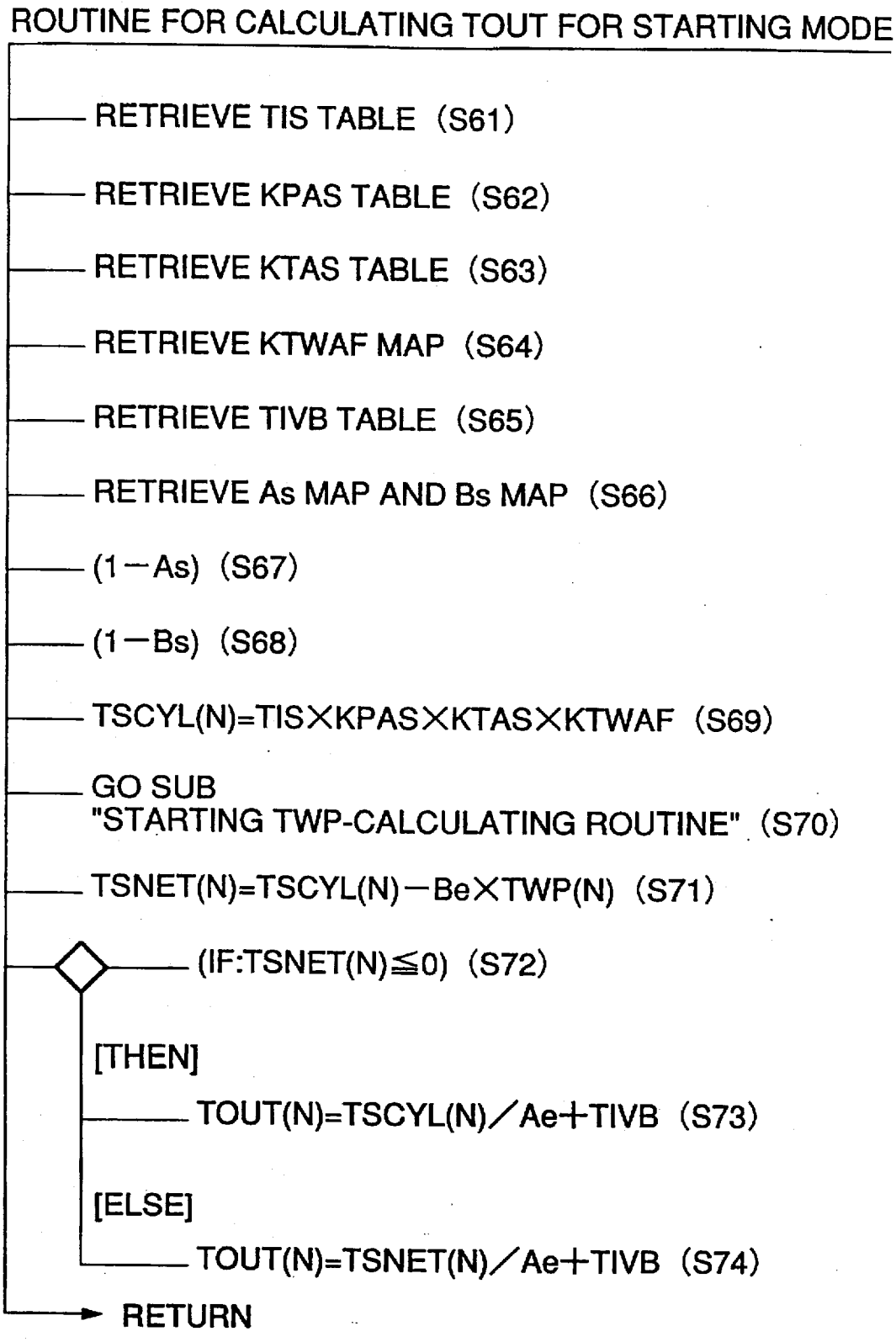
FIG. 9 is a diagram showing a routine for calculating the fuel injection period (TOUT) in a starting mode of the engine.
Figure 10:
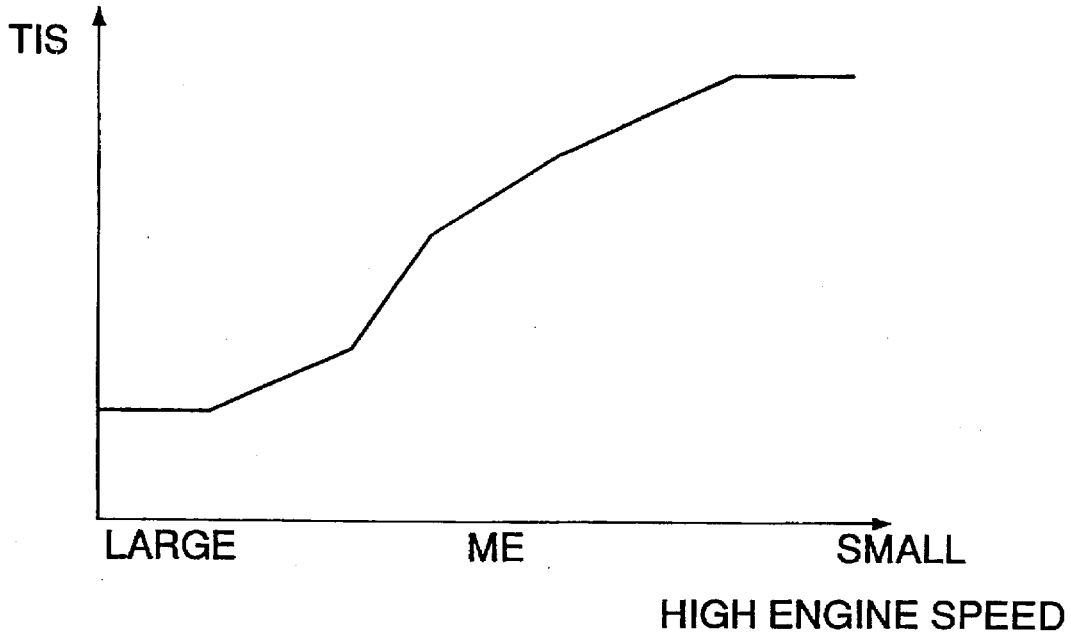
FIG. 10 shows a TIS table for determining a starting basic fuel injection amount (TIS) applied in the starting mode.

Referring to FIG. 9, at a step S61, a starting basic fuel injection amount TIS is determined by retrieving a TIS table. The TIS table is set, e.g. as shown in FIG. 10, such that as the reciprocal ME of the engine rotational speed NE decreases (as the engine rotational speed NE increases), the starting basic fuel injection amount TIS is set to a larger value.

Figure 11:
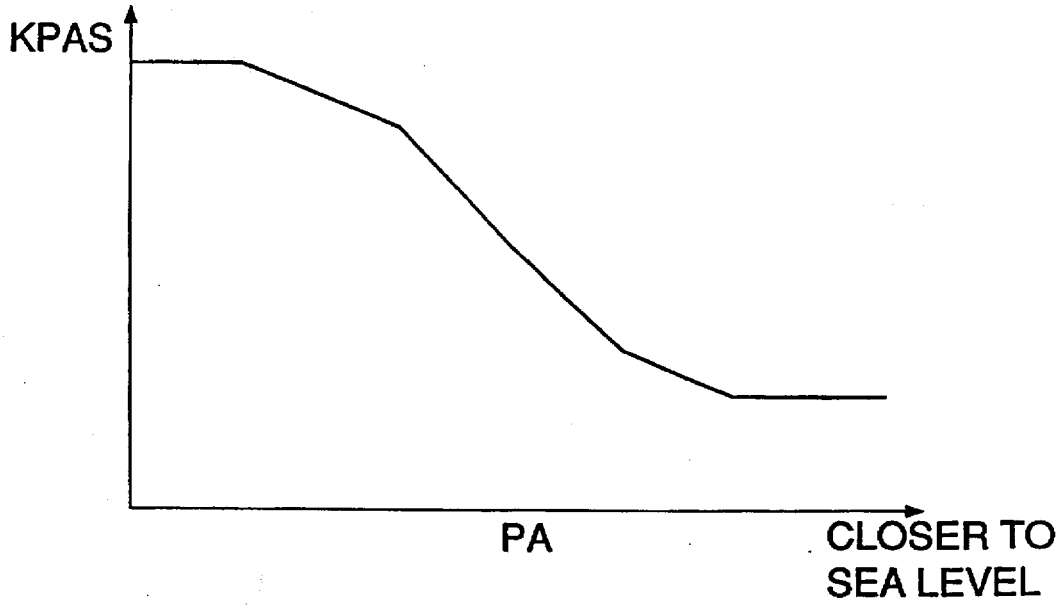
FIG. 11 shows a KPAS table for determining an atmospheric pressure-dependent coefficient (KPAS) for correcting the fuel injection amount applied in the starting mode.

At a step S62, an atmospheric pressure-dependent correction coefficient KPAS for correcting the starting basic fuel injection amount TIS is determined by retrieving a KPAS table. The KPAS table is set, e.g. as shown in FIG. 11, such that as the atmospheric pressure PA increases (as the vehicle is traveling at an altitude closer to the sea level), the atmospheric pressure-dependent correction coefficient KPAS is set to a smaller value.

Figures 12, 13:
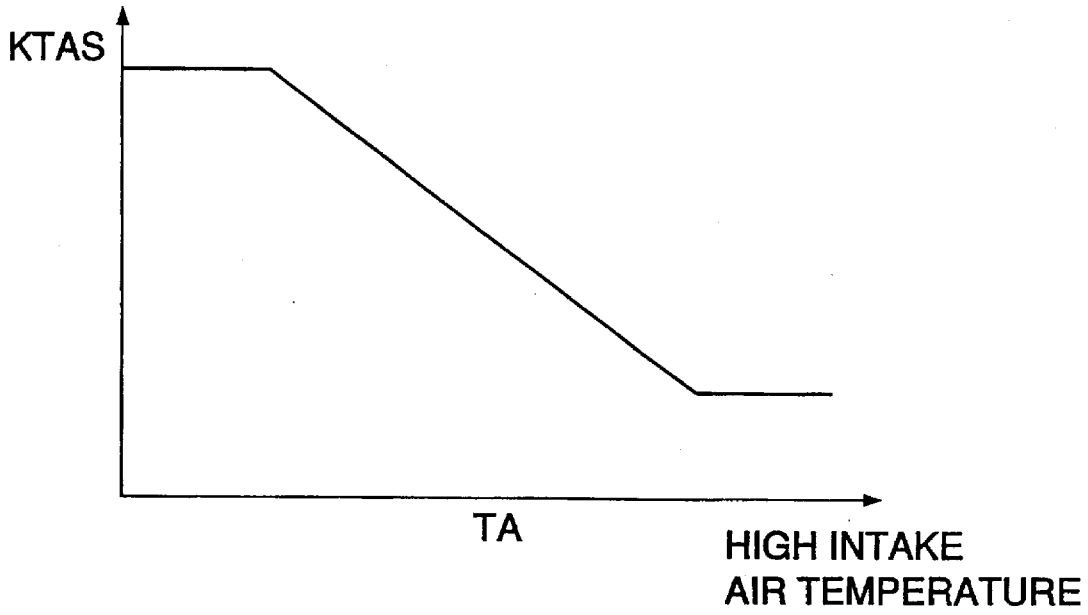
FIG. 12 shows a KTAS table for determining an air intake temperature-dependent correction coefficient (KTAS) for correcting the fuel injection amount applied in the starting mode.
FIG. 13 shows a KTWAF map for determining a starting desired air-fuel ratio-dependent correction coefficient (KTWAF) for correcting the fuel injection amount applied in the starting mode.

Further, at a step S63, an intake air temperature-dependent correction coefficient KTAS is determined by retrieving a KTAS table. The KTAS table is set, e.g. as shown in FIG. 12, such that as the intake air temperature TA increases, the intake air temperature-dependent correction coefficient KTAS is set to a smaller value.

At a step S64, a desired starting air-fuel ratio correction coefficient-dependent KTWAF is determined by retrieving a KTWAF map. The KTWAF map is set, e.g. as shown in FIG. 13, such that map values are provided in a manner corresponding to the reciprocal ME of the engine rotational speed NE and the engine coolant temperature TW.

Figure 14:
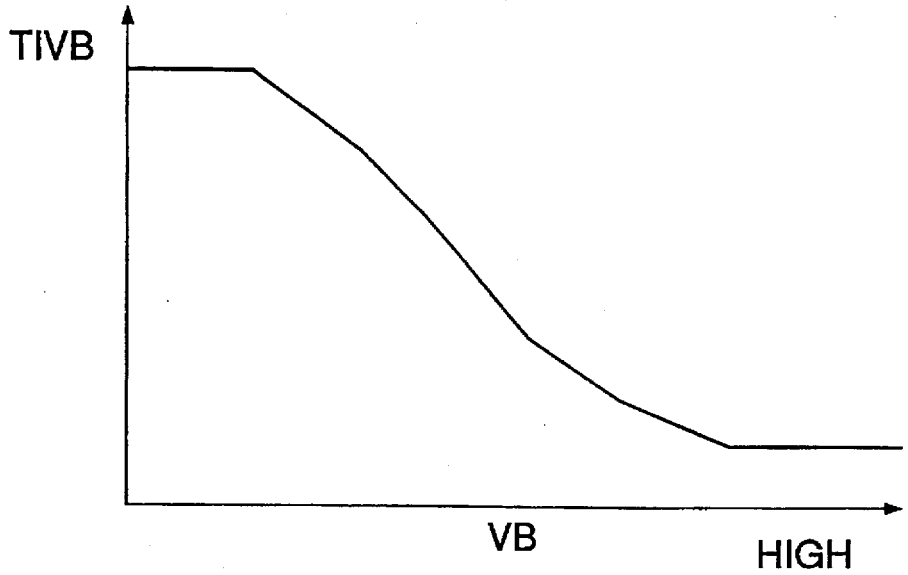
FIG. 14 shows a TIVB table for determining a battery voltage-dependent correction term(TIVB) representative of an ineffective time dependent on battery voltage.

At a step S65, a battery voltage-dependent correction term TIVB is determined by retrieving a TIVB table. The TIVB table is set, e.g. as shown in FIG. 14, such that as the battery voltage VB increases, the battery voltage-dependent correction term TIVB is set to a smaller value.

Figure 15:
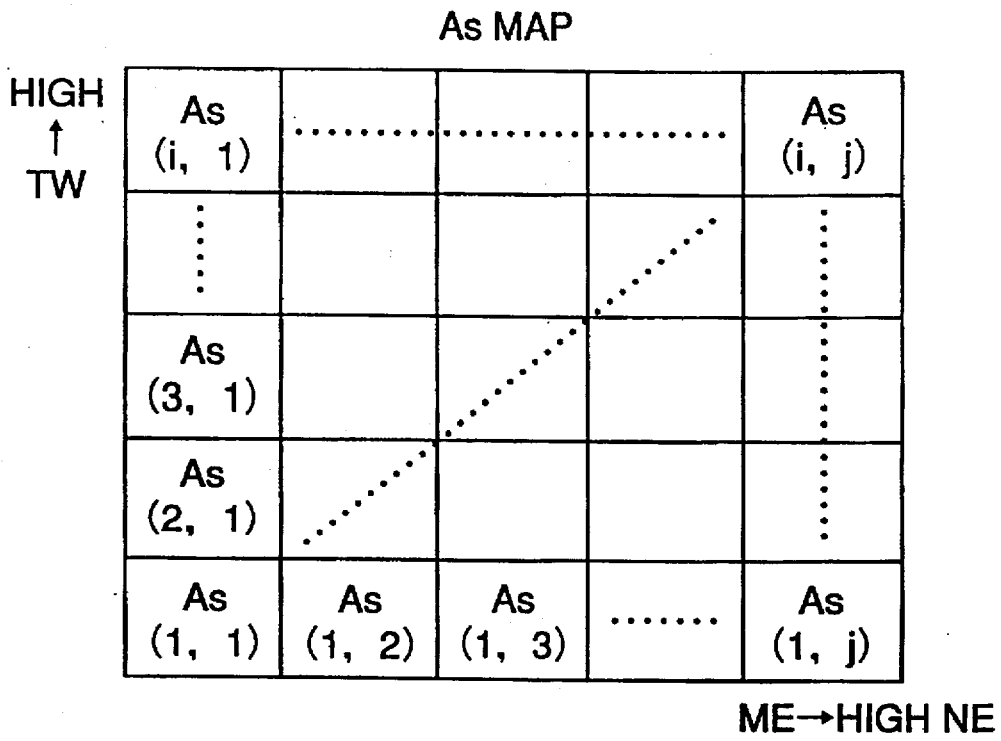
FIG. 15 shows an As map for determining a parameter for the adhering fuel-dependent correction applied in the starting mode.

Further, at a step S66, the starting direct supply ratio As and the starting carry-off ratio Bs are determined by retrieving an As map and a Bs map. The As map is set, e.g. as shown in FIG. 15, such that map values of the starting direct supply ratio As are provided in a manner corresponding to load on the engine, the reciprocal ME, and the engine coolant temperature TW. The Bs map, not shown, is set in a similar manner.

It should be noted that the starting direct supply ratio As means a ratio of the amount of fuel injected from the fuel injection valve 6 and directly drawn into the combustion chamber during the present cycle to the amount of fuel injected during the present cycle, which is to be applied in the starting mode of the engine, while the starting carry-off ratio Bs is a ratio of the amount of fuel vaporized and carried off from fuel adhering to the inner wall surface of the intake pipe 2 and drawn into the combustion chamber during the present cycle, to the amount of the fuel adhering to the inner wall surface of the intake pipe 2, which is to be applied in the starting mode of the engine, as well.

At the following step S67, (1−AS) is calculated, and further at a step S68, (1−Bs) is calculated. Then, at a step S69, a starting required fuel amount TSCYL(N) is calculated for each cylinder by the use of the following equation (5):

$$TSCYL(N)=TIS\times KPAS\times KTAS\times KTWAF \quad (5)$$

where N represents an integer indicative of the cylinder concerned, and hence assumes a value from 1 to 4.

At the following step S70, a starting adhering fuel amount-calculating routine is executed to calculate an adhering fuel amount TWP(N) in the starting mode.

Figure 16:
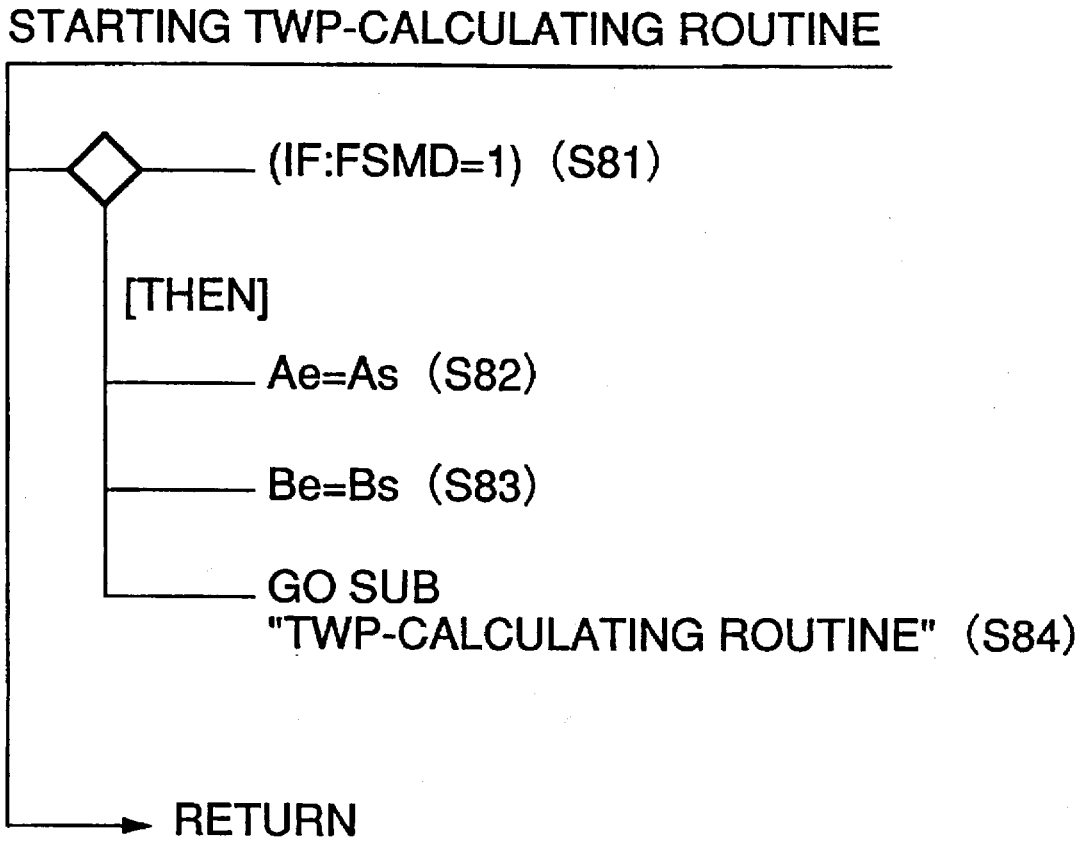
FIG. 16 is a flowchart showing a main routine for calculating an adhering fuel amount (TWP) in the starting mode.

FIG. 16 shows the starting adhering fuel amount-calculating routine, which is executed for each cylinder in synchronism with generation of each CRK signal pulse.

First, at a step S81, it is determined whether or not the flag FMSD assumes "1". If FMSD=1 holds, i.e. if the engine is in the starting mode, the program proceeds to a step S82, wherein the starting direct supply ratio As is substituted for the final direct supply ratio Ae, and then the program proceeds to a step S83, wherein the starting carry-off ratio Bs is substituted for the final carry-off supply ratio Be.

By the use of these substituted values of the final direct supply ratio Ae and the final carry-off ratio Be, an adhering fuel amount (TWP)-calculating routine, described below, is executed, followed by terminating the program.

Figure 17:
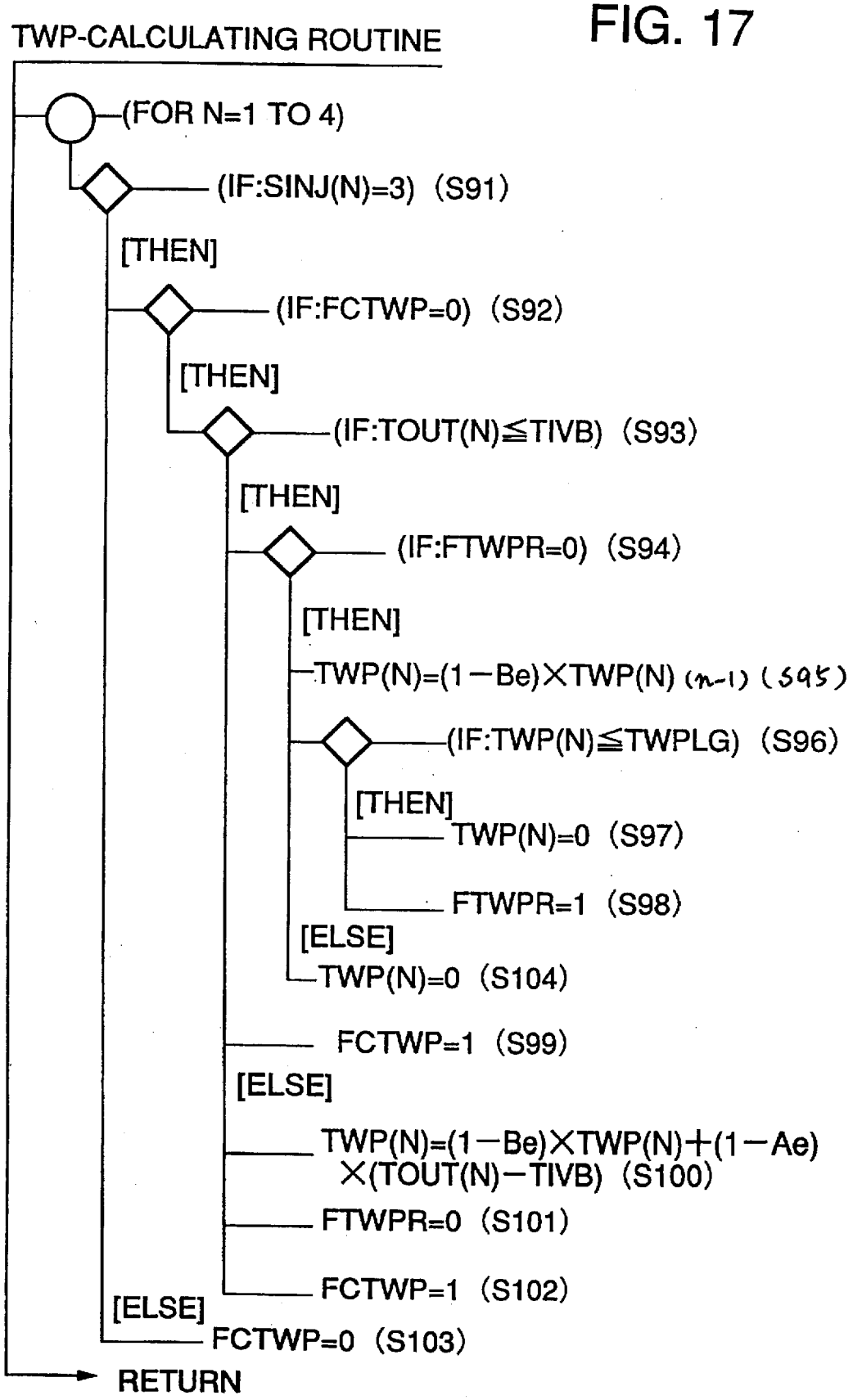
FIG. 17 is a flowchart showing a subroutine for calculating the adhering fuel amount (TWP).

FIG. 17 shows the TWP-calculating routine for calculating the adhering fuel amount TWP, which is executed for each cylinder in synchronism with generation of each CRK signal pulse.

First, it is determined at a step S91 whether or not the status number SINJ(N) (see FIG. 2) is equal to "3", which indicates termination of fuel injection. If the status member SINJ(N) is not equal to 3, a calculation start-permitting flag FCTWP is set to "0" at a step S103 to permit the calculation of the adhering fuel amount TWP to be started in the next loop, whereas if the status member SINJ(N) is equal to 3, it is determined at a step S92 whether or not the flag FCTWP assumes "0". If the flag FCTWP assumes "0", it is determined at a step S93 whether or not the final fuel injection period TOUT(N) is equal to or smaller than an ineffective time period represented by the battery voltage-dependent correction term TIVB (calculated at a step S73 or S74, referred to hereinafter, of the FIG. 9 routine). If TOUT(N) ≦TIVB holds, which means that no fuel is to be injected, it is determined at a step S94 whether or not a flag FTWPR assumes "0", which means that the adhering fuel amount TWP(N) is not negligible or zero. If the flag FTWPR assumes "0" and hence the adhering fuel amount TWP is not negligible or zero, the program proceeds to a step S95, wherein the adhering fuel amount TWP(N) in the present loop is calculated by the use of the following equation (6):

$$TWP(N)=(1-Be)\times TWP(N)(n-1) \quad (6)$$

where TWP(N)(n−1) represents an immediately preceding value of the adhering fuel amount.

Then, it is determined at a step S96 whether or not the adhering fuel amount TWP(N) is equal to or smaller than a predetermined very small value TWPLG. If TWP(N) ≦TWPLG holds, it is judged that the adhering fuel amount TWP(N) is negligible or zero, so that the adhering fuel amount TWP(N) is set to "0" at a step S97 and the flag FTWPR is set to "1" at a step S98. Then, at a step S99, the flag FCTWP is set to "1" to indicate completion of the calculation of the adhering fuel amount TWP, followed by terminating the program.

If FTWPR=1 holds at the step S94, the adhering fuel amount TWP(N) can be regarded to be equal to "0", and hence the adhering fuel amount TWP(N) is set to "0" at a step S104.

On the other hand, if TOUT(N)>TIVB holds at the step S93, which means that fuel is to be injected, the program proceeds to a step S100, wherein the adhering fuel amount TWP(N) is calculated by the use of the following equation (7):

$$TWP(N)=(1-Be)\times TWP(N)(n-1)+(1-Ae)\times(TOUT(N)-TIVB) \quad (7)$$

where TWP(N)(n−1) represents the immediately preceding value of the adhering fuel amount TWP(N). The first term on the right side represents an amount of fuel which has not been carried off from the adhering fuel and remains on the inner wall surface of the intake pipe during the present cycle, and the second term on the right side represents an amount of fuel corresponding to a portion of injected fuel which has not been drawn into the combustion chamber and newly attached to the inner wall surface of the intake pipe 2.

Then, the flag FTWPR is set to "0" at a step S101 to indicate that the adhering fuel is still present in the amount TWP, and further the flag FCTWP is set to "1" to indicate completion of the calculation of the adhering fuel amount TWP at a step S102, followed by terminating the program.

Then, the program returns to the FIG. 9 routine, wherein at a step S71, a net starting fuel injection amount TSNET(N) is calculated by applying the adhering fuel amount TWP(N) thus obtained to the following equation (8):

$$TSNET(N)=TSCYL(N)-Be\times TWP(N) \quad (8)$$

where Be×TWP(N) corresponds to an amount of fuel carried off from the fuel adhering to the inner wall surface of the intake pipe into the combustion chamber. This amount of fuel carried off into the combustion chamber need not be newly injected, and hence it is subtracted from the starting required fuel amount TSCYL(N).

At a step S72, it is determined whether on not the TSNET value calculated by the use of the equation (8) is equal to or smaller than "0". If TSNET≧0 holds, the final fuel injection period TOUT(N) is calculated by the use of the following equation (9):

$$TOUT(N)=TSCYL(N)/Ae+TIVB \quad (9)$$

where TIVB represents the aforementioned battery voltage-dependent correction term.

This step enables an amount of fuel corresponding to (TSCYL(N)/Ae) to be injected even when the net starting fuel injection amount TNET(N) is equal to or smaller than 0, thereby preventing the engine from undergoing unstable combustion due to shortage of fuel supplied to the combustion chamber even if the engine is operating immediately after the fuel tank is newly refilled with a fuel having a low volatility.

On the other hand, if TSNET>0 holds, the final fuel injection time period TOUT(N) is calculated at a step S74, by the use of the equation (10), followed by terminating the program:

$$TOUT(N)=TSNET(N)/Ae+TIVB \quad (10)$$

By opening the fuel injection valve 6 over the final fuel injection period TOUT(N) for the starting model calculated by the use of the equation (10), an amount of fuel corresponding to the required fuel amount TSCYL(N) (=TSNET (N)+Be×TWP(N)) is supplied to the combustion chamber.

The processing described above is carried out for each of the cylinders #1 to #4, to determine the final fuel injection period TOUT(N) (N=1 to 4).

Referring again to the step S14 of the FIG. 3 main routine, if the flag FSMOD assumes "0", i.e. if the engine is in the basic mode, the program proceeds to a step S16, wherein the required fuel amount TCYL(N) is calculated by the use of the following equation (11):

$$TCYL(N)=TIM\times KTOTAL(N)\times KLAF+TTOTAL(N) \quad (11)$$

where TIM represents a basic fuel injection amount determined according to the engine rotational speed NE and the intake pipe absolute pressure PBA, KLAF an air-fuel ratio correction coefficient set based on the output from the LAF sensor 24, KTOTAL(N) the product of all correction coefficients which are determined based on engine operating parameters detected by various sensors including the aforementioned ones, e.g. an after-start enriching correction coefficient KAST, an engine coolant temperature-dependent correction coefficient KTW, a leaning correction coefficient KLS, and the EGR-dependent correction coefficient KEGR, excluding the air-fuel ratio correction coefficient KLAF, and TTOTAL(N) the sum of all addend correction terms which are determined based on engine operating parameters, e.g. an acceleration enriching term TACC, excluding the battery voltage-dependent correction term TIVB representative of the ineffective time period of the fuel injection valve.

At the following step S17, a net fuel injection amount TNET(N) is calculated by the use of the following equation (12), similarly to the step S71 in FIG. 9, wherein the starting net fuel injection amount TSNET(N) is calculated by the use of the equation (8):

$$TNET(N)=TCYL(N)-Be\times TWP(N) \quad (12)$$

In the basic mode as well, the adhering fuel amount TWP(N) is calculated by the FIG. 17 routine. Then, at a step S18, it is determined whether or not the net fuel injection amount TNET(N) calculated above is equal to or smaller than "0". If TSNET≦0 holds, it is determined at a step S19 whether or not the after-start enriching correction coefficient KAST is larger than 1.0.

The after-start enriching correction coefficient KAST is initialized according to the engine coolant temperature TW upon termination of the starting mode, and is progressively decreased with the lapse of time until it becomes equal to "1.0".

If KAST>1.0 holds at the step S19, it is determined that the engine is in a starting condition, i.e. immediately after the engine has been started, and the final fuel injection period TOUT(N) is calculated at a step S20 by the use of the following equation (13):

$$TOUT(N)=TCYL(N)/Ae+TIVB \quad (13)$$

This step enables an amount of fuel corresponding to (TCYL(N)/Ae) to be injected even when the net fuel injection amount TNET(N) is equal to or smaller than 0, thereby preventing the engine from undergoing unstable combustion due to an insufficient amount of fuel being supplied to the combustion chamber even if the engine is operating after the fuel tank is newly refilled with a fuel having a low volatility.

On the other hand, if KAST≦1.0 holds at the step S19, which implies that the engine is not in the just-started condition, TOUT(N)=0 is set at a step S21, followed by terminating the program.

Further, if TSNET(N)>0 holds at the step S18, the final fuel injection period TOUT(N) is calculated at a step S22, by the use of the following equation (14), followed by terminating the program:

$$TOUT(N)=TNET(N)/Ae+TIVB \quad (14)$$

Thus, according to the present embodiment, so long as the engine is in a starting condition (during cranking or immediately after the engine has been started), i.e. when the engine is in the starting mode or the after-start enriching correction coefficient KAST>1.0 holds immediately after the start of the engine, an amount of fuel corresponding to (TCYL(N)/Ae) is injected even if the net fuel injection amount TNET(N) calculated is equal to or smaller than 0. As a result, it is possible to prevent the engine from undergoing unstable combustion due to an insufficient amount of fuel being supplied to the combustion chamber even if the engine is operating immediately after the fuel tank is newly refilled with a fuel having a low volatility.

Further, so long as the count CCYL is smaller than the predetermined value X, which means that the time period corresponding to the predetermined value X has elapsed after the start of the engine, the after-start adhering fuel-determining parameter correction coefficients KASA, KASB are calculated according to the count CCYL to thereby correct the final direct supply ratio Ae and the final carry-off ratio Be, respectively. As a result, it is possible to take into account the temperature of the intake valves, which is one of the principal factors of the parameters applied in the execution of the adhering fuel-dependent correction of the fuel injection amount and has a significant effect on the degree of evaporation of the fuel adhering to the intake valves, etc. immediately after the start of the engine, to thereby enable carrying out the adhering fuel-dependent correction of the fuel injection amount in such a manner that the convergence of the air-fuel ratio is enhanced, noxious components of exhaust gases are reduced, and so forth, immediately after the start of the engine.

In addition, the determination at the step S18 of the FIG. 3 main routine or at the step S72 of the FIG. 9 subroutine may be alternatively carried out by comparing the net fuel injection amount TNET(N) or the net starting fuel injection amount TSNET(N) with a very small value close to 0, instead of comparing the value TSNET(N) or TSNET(N) with 0.

Although in the present embodiment described above, at the step 39 in FIG. 4, the count CCYL, which is a cumulative value of CRK signal pulses, is calculated to determine at the step S40 whether or not the time period corresponding to the predetermined value X has elapsed after the start of the engine, this is not limitative, but instead of using the count CCYL, there may be employed a time period measured by a timer which is started to operate simultaneously when the ignition key is turned on. In this case, the measured time period is compared with a predetermined time period which corresponds to a cranking time period to thereby determine whether the elapsed time period after the start of the engine has exceeded a predetermined time period. Further, a cumulative value of the frequency of explosion within the combustion chamber may be applied instead of the count CCYL. In this case, at the step in FIG. 4, the frequency of explosion is measured, e.g. by counting TDC signal pulses generated, and then at the step S40 in FIG. 4 the resulting count, i.e. the cumulative number of TDC signal pulses generated is compared with a predetermined count value corresponding to the predetermined count value X.

What is claimed is:

1. In a fuel injection control system for an internal combustion engine having an intake passage having an inner wall surface, and at least one combustion chamber, said fuel injection control system including fuel supply amount-calculating means for calculating an amount of fuel to be supplied to said engine, based on operating conditions of said engine including at least load on said engine, adhering fuel amount-calculating means for calculating an amount of fuel adhering to said inner wall surface of said intake passage of said engine, by the use of adhering fuel parameters representative of transfer characteristics of fuel injected into said intake passage, carried-off fuel amount-calculating means for calculating an amount of fuel to be carried off from said fuel adhering to said inner wall surface of said intake passage into said at least one combustion chamber, by the use of said adhering fuel parameters, corrected fuel injection amount-calculating means for calculating a corrected fuel injection amount by correcting of said amount of fuel calculated by said fuel supply amount-calculating means according to said amount of fuel adhering to said inner wall surface of said intake passage and said amount of fuel to be carried-off from said fuel adhering to said inner wall surface, and fuel injection control means for injecting fuel in said corrected fuel injection amount into said intake passage;

the improvement comprising:

after-start time period-measuring means for measuring a time period elapsed after said engine is started; and after-start correction amount-calculating means for calculating an after-start correction amount of said corrected fuel injection amount according to said time period elapsed after said engine is started;

wherein said corrected fuel injection amount-calculating means calculates said corrected fuel injection amount based on said after-start correction amount of said corrected fuel injection amount until said time period elapsed after said engine is started reaches a predetermined time period.

2. A fuel injection control system according to claim 1, wherein said after-start time period-measuring means measures said time period elapsed after said engine is started by counting a number of cycles of fuel injection of said engine occurring after said engine is started.

3. A fuel injection control system according to claim 2, wherein said engine includes a plurality of cylinders, said after-start time period-measuring means calculating a cumulative number of pulses generated at a predetermined crank angle position of a particular cylinder of said plurality of cylinders and measuring said time period elapsed after said engine is started based on said cumulative number of said pulses.

4. A fuel injection control system according to claim 1, wherein said after-start correction amount-calculating means calculates said after-start correction amount in a manner such that said after-start correction amount becomes smaller as said time period elapsed after said engine is started becomes closer to said predetermined time period.

5. A fuel injection control system according to claim 2, wherein said after-start correction amount-calculating means calculates said after-start correction amount in a manner such that said after-start correction amount becomes smaller as said time period elapsed after said engine is started becomes closer to said predetermined time period.

6. A fuel injection control system according to claim 1, wherein said adhering fuel parameters comprise a direct supply ratio representative of a ratio of an amount of fuel directly drawn into said at least one combustion chamber during one cycle of fuel injection to an amount of fuel injected during said one cycle, and a carried-off ratio representative of a ratio of an amount of fuel to be carried off from said fuel adhering to said inner wall surface of said intake passage to an amount of fuel adhering to said inner wall surface of said intake passage during said one cycle of fuel injection, said after-start correction amount-calculating means calculating said after-start correction amount of said corrected fuel injection amount by the use of a correction coefficient for correcting said direct supply ratio and a correction coefficient for correcting said carried-off ratio each set according to said time period elapsed after said engine is started.

7. A fuel injection control system according to claim 4, wherein said adhering fuel parameters comprise a direct supply ratio representative of a ratio of an amount of fuel directly drawn into said at least one combustion chamber during one cycle of fuel injection to an amount of fuel injected during said one cycle, and a carried-off ratio representative of a ratio of an amount of fuel to be carried off from said fuel adhering to said inner wall surface of said intake passage to an amount of fuel adhering to said inner wall surface of said intake passage during said one cycle of fuel injection, said after-start correction amount-calculating means calculating said after-start correction amount of said corrected fuel injection amount by the use of a correction coefficient for correcting said direct supply ratio and a correction coefficient for correcting said carried-off ratio each set according to said time period elapsed after said engine is started.

8. A fuel injection control system according to claim 3, wherein said correction coefficient for said direct supply ratio and said correction coefficient for correcting said carried-off ratio are each set according to said time period elapsed after said engine is started in a manner such that said corrected fuel injection amount becomes smaller as said time period elapsed after said engine is started becomes closer to said predetermined time period.

9. A fuel injection control system according to claim 1, including starting condition-detecting means for detecting a starting condition of said engine, and wherein said corrected fuel injection amount-calculating means calculates said corrected fuel injection amount based on a during-start correction amount calculated in a manner suitable for said starting condition of said engine instead of said after-start correction amount of said corrected fuel injection amount, said fuel injection control means injecting fuel into said intake passage in an amount at least larger than a predetermined value if said corrected fuel injection amount calculated based on said during-start correction amount is below said predetermined value.

10. A fuel injection control system according to claim 2, including starting condition-detecting means for detecting a starting condition of said engine, and wherein said corrected fuel injection amount-calculating means calculates said corrected fuel injection amount based on a during-start correction amount calculated in a manner suitable for said starting condition of said engine instead of said after-start correction amount of said corrected fuel injection amount, said fuel injection control means injecting fuel into said intake passage in an amount at least larger than a predetermined value if said corrected fuel injection amount calculated based on said during-start correction amount is below said predetermined value.

11. In a fuel injection control system for an internal combustion engine having an intake passage and at least one combustion chamber, said intake passage having an inner wall surface, said fuel injection control system including fuel supply amount-calculating means for calculating an amount of fuel to be supplied to said engine, based on operating conditions of said engine including at least load on said engine, adhering fuel amount-calculating means for calculating an amount of fuel adhering to said inner wall surface of said intake passage of said engine, by the use of adhering fuel parameters representative of transfer characteristics of fuel injected into said intake passage, carried-off fuel amount-calculating means for calculating an amount of fuel to be carried off from said fuel adhering to said inner wall surface of said intake passage into said at least one combustion chamber, by the use of said adhering fuel parameters, corrected fuel injection amount-calculating means for calculating a corrected fuel injection amount by correcting said amount of fuel calculated by fuel supply amount-calculating means according to said amount of fuel adhering to said inner wall surface of said intake passage and said amount of fuel to be carried-off from said fuel adhering to said inner wall surface, and fuel injection control means for injecting fuel in said corrected fuel injection amount into said intake passage;

the improvement comprising:

count means for counting a number of times of explosion of said engine; and after-start correction amount-calculating means for calculating an after-start correction amount of said corrected fuel injection amount according to said number of times of explosion of said engine, wherein said corrected fuel injection amount-calculating means calculates said corrected fuel injection amount based on said after-start correction amount of said corrected fuel injection amount until said number of times of explosion of said engine reaches a predetermined number.

12. A fuel injection control system according to claim 11, wherein said engine includes a plurality of cylinders, said count means calculating a cumulative number of pulses generated at a predetermined crank angle position of each of said plurality of cylinders and measuring said number of times of explosion based on said cumulative number of said pulses.

13. A fuel injection control system according to claim 11, wherein said after-start correction amount-calculating means calculates said after-start correction amount in a manner such that said after-start correction amount becomes smaller as said number of times of explosion of said engine becomes closer to said predetermined number.

14. A fuel injection control system according to claim 11, wherein said adhering fuel parameters comprise a direct supply ratio representative of a ratio of an amount of fuel directly drawn into said at least one combustion chamber during one cycle of fuel injection to an amount of fuel injected during said one cycle, and a carried-off ratio representative of a ratio of an amount of fuel to be carried off from said fuel adhering to said wall surface of said intake passage to an amount of fuel adhering to said inner wall surface of said intake passage during said one cycle of fuel injection, said after-start correction amount-calculating means calculating said after-start correction amount of said corrected fuel injection amount by the use of a correction coefficient for correcting said direct supply ratio and a correction coefficient for correcting said carried-off ratio each set according to said number of times of explosion.

15. A fuel injection control system according to claim 12, wherein said adhering fuel parameters comprise a direct supply ratio representative of a ratio of an amount of fuel directly drawn into said at least one combustion chamber during one cycle of fuel injection to an amount of fuel injected during said one cycle, and a carried-off ratio representative of a ratio of an amount of fuel to be carried off from said fuel adhering to said wall surface of said intake passage to an amount of fuel adhering to said inner wall surface of said intake passage during said one cycle of fuel injection, said after-start correction amount-calculating means calculating said after-start correction amount of said corrected fuel injection amount by the use of a correction coefficient for correcting said direct supply ratio and a correction coefficient for correcting said carried-off ratio each set according to said number of times of explosion.

16. A fuel injection control system according to claim 14, wherein said correction coefficient for said direct supply ratio and said correction coefficient for correcting said carried-off ratio are each set according to said number of times of explosion in a manner such that said corrected fuel injection amount becomes smaller as said number of times of explosion of said engine becomes closer to said predetermined number.

* * * * *